United States Patent [19]

Ziels

[11] 4,359,800

[45] Nov. 23, 1982

[54] SOOTBLOWER FEED AND LANCE TUBE STRUCTURE WITH IMPROVED TURBULIZER SYSTEM

[75] Inventor: Burton D. Ziels, Lancaster, Ohio

[73] Assignee: The Babcock & Wilcox Company, New Orleans, La.

[21] Appl. No.: 240,799

[22] Filed: Mar. 5, 1981

[51] Int. Cl.[3] ..... F23J 3/02

[52] U.S. Cl. ..... 15/316 R; 165/109 T; 239/DIG. 13

[58] Field of Search ..... 15/316 R, 317, 318; 165/109 T; 239/DIG. 13

[56] References Cited

FOREIGN PATENT DOCUMENTS 1229854 3/1959 France ..... 165/109 T

*Primary Examiner*—Chris K. Moore

*Attorney, Agent, or Firm*—Harness, Dickey & Pierce

[57] ABSTRACT

The feed tube of a long retracting sootblower has a lance tube slidably overfitted thereon which is of an inside diameter somewhat exceeding the outside diameter of the feed tube, to provide a relatively narrow gap therebetween. The open end of the feed tube has a turbulizer mounted therein contoured to impart a helical component to the blowing fluid which blows into the lance tube from the feed tube. At a position spaced upstream from the turbulizer the wall of the feed tube is pierced with a plurality of holes equally spaced throughout its periphery. The holes provide centering jets which oppose vibration of the feed tube and prevent impacting of the same against the interior of the lance tube.

4 Claims, 8 Drawing Figures

SOOTBLOWER FEED AND LANCE TUBE STRUCTURE WITH IMPROVED TURBULIZER SYSTEM

BACKGROUND OF THE INVENTION

The lance tubes of long retracting sootblowers which during operation are projected into high temperature zones of heat exchangers such as large public utility and industrial boilers and the like are protected against heat damage while in the heat exchanger by the cooling effect of the blowing medium (typically steam or air) flowing therethrough. (References herein to "boilers" are intended to encompass other types of heat exchangers). In order to enhance the efficiency of such cooling effect, turbulizing devices are commonly used at the open end of the feed tube to impart a helical motion to the blowing medium as it enters the lance tube, thereby providing a desired degree of turbulence and increasing effective contact between the blowing medium and the wall of the lance tube.

Where high rates of flow of blowing medium are required, the use of turbulizers has in the past become impractical, above certain flow rates, because vibration of the feed tube occurs and under some conditions is so severe that the resultant impacting of the feed tube against the lance tube causes rapid failure of the latter due to fatigue.

The overall objective of the present invention is to provide an improved turbulizer-equipped sootblower feed tube and lance tube construction which prevents such damaging vibration and failure at flow rates up to values greatly exceeding those which could previously be employed.

Other objects and advantages of the invention will be apparent to persons skilled in the art upon consideration of the present disclosure in its entirety.

BRIEF DESCRIPTION OF THE FIGURES OF DRAWING

DETAILED DESCRIPTION OF PREFERRED FORM OF THE INVENTION

Figure 1:
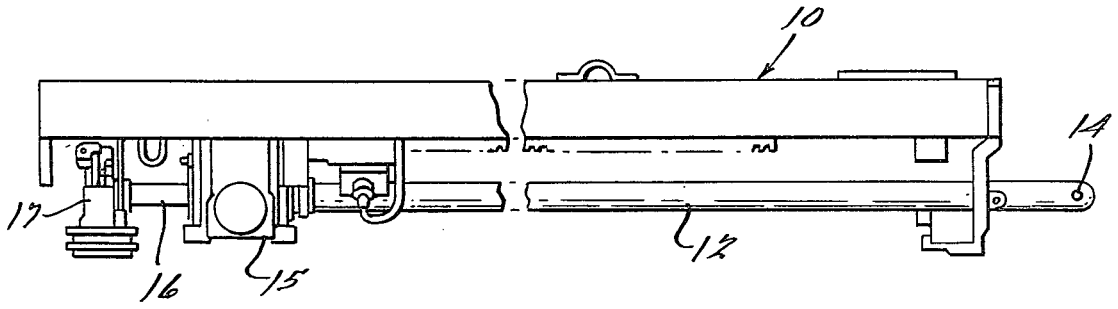
FIG. 1 is a side elevational view, centrally broken away, of a long travel sootblower of the well known IK type, provided with a turbulizer-equipped feed tube assembly and incorporating the principles of the present invention.

Reference character 10 designates generally a sootblower of the well known "IK" type, the general construction of which may conform to the disclosure of the U.S. Pat. No. 2,668,978 to DeMart, granted Feb. 16, 1954. Various modified features, also well known in the trade, have been incorporated in such long travel sootblowers during the years since the issuance of the DeMart patent, but such details are not involved in the present invention and the shown blower of the DeMart construction will be recognized as typical of the structural environment wherein the present invention can be advantageously employed.

The lance tube 12 of such sootblowers is during operation projected into a boiler or the like (presumed to be located at the right in FIG. 1) to clean the heat exchanging surfaces by the discharge of steam and/or air from nozzle means 14 positioned near the end of the lance. The lance tube is attached to and projectable and retractable by means of a motor-driven carriage 15, which typically also imparts to the lance a rotary or oscillatory motion about its longitudinal axis. The lance tube is slidably overfitted upon a stationary feed tube assembly which includes a feed tube element 16. The feed tube has a discharge end 19 which opens into the lance tube and through which blowing medium under pressure is fed into the lance tube for discharge in the manner described. In the typical construction illustrated in FIG. 1 the blowing fluid is delivered to the feed tube from a source (not shown) under pressure, such as a steam drum of the boiler, and/or a pressurized air supply, under the control of a blow valve 17.

Because of high temperature conditions and wide temperature variations to which the lance tube is typically subjected, and other considerations, the inside diameter of the lance tube is substantially greater than the outside diameter of the feed tube, leaving a gap 18 of generally annular cross section therebetween.

In order to prevent damage to the lance tube by the high temperatures prevailing within the boiler or other heat exchanger, the lance tube is retracted to a position outside the boiler when not in use. While it is in the boiler, it is necessary to provide a sufficient volumetric flow of blowing medium to maintain the temperature of the lance tube at a safe level, regardless of the flow required for effective cleaning at the given location.

When the lance tube is extended and blowing medium is flowing, the characteristics of the flow of the medium within the lance tube will affect its cooling efficiency. For example, if the flow of blowing medium through the lance were essentially laminar, cooling of the lance in a direction outwardly toward the nozzle would fall off rapidly because the same components of the blowing medium would remain close to the inner wall of the lance tube and become highly heated while cooler inner portions of the flowing fluid nearer the axis would be prevented from effective contact with the wall of the lance tube. It will be recognized that these factors are relative in the sense that true laminar flow probably never occurs under these conditions. In order to increase the turbulence of the blowing medium in the lance tube to a desired degree and promote efficient contact between the blowing medium and the lance tube wall, turbulizing devices have been employed at the open forward end of the feed tube, as noted above.

Figure 2:
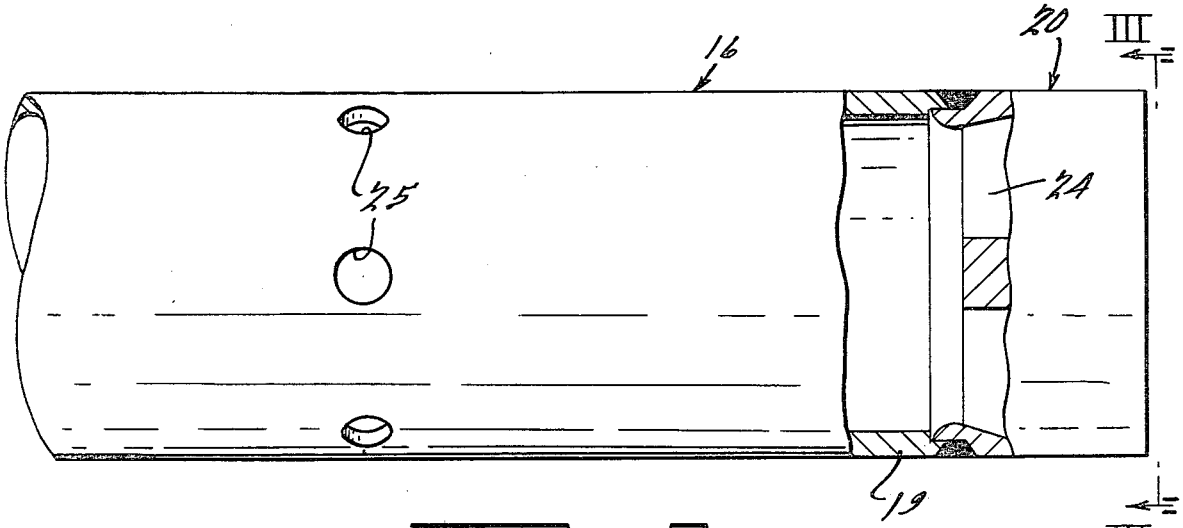
FIG. 2 is a fragmentary side elevational view, partly in diametric section, of the end portion of the feed tube.
Figure 3:
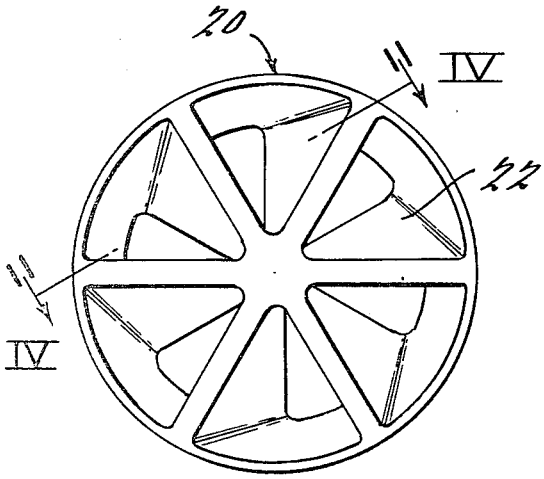
FIG. 3 is an end elevational view taken as indicated by the line and arrows III—III in FIG. 2.
Figure 4:
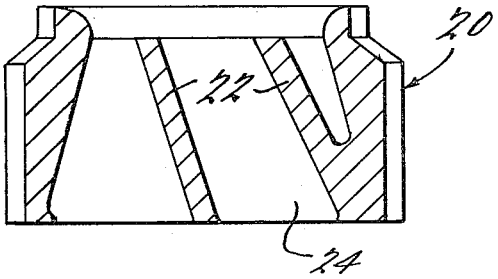
FIG. 4 is a cross sectional view of the turbulizer taken substantially on the line IV—IV of FIG. 3 and looking in the direction of the arrows.
Figure 5:
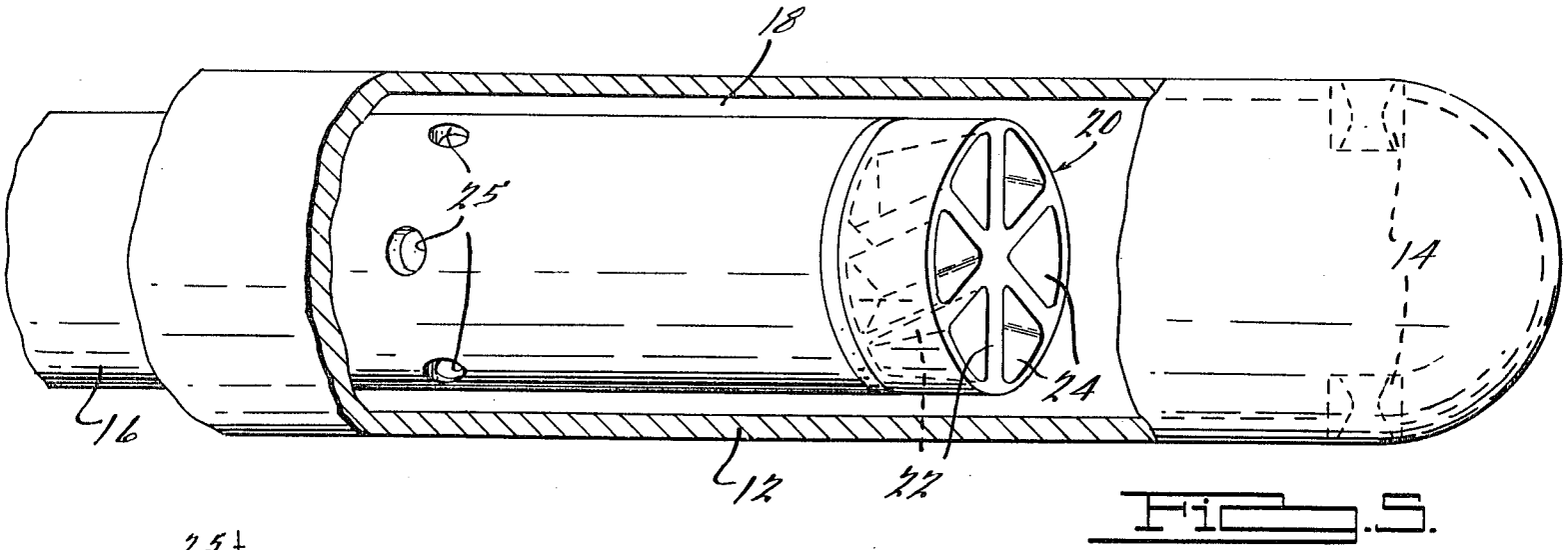
FIG. 5 is a perspective view of the outer end portions of the lance tube and feed tube taken from the side in the relative positions they occupy when the lance tube is retracted and with the lance tube broken away to show the end portions of the feed tube including the turbulizer and reaction jet orifices.

A turbulizer installation of a known type is shown in FIGS. 2 and 5. The turbulizer unit 20 is welded to the open forward end of and constitutes a short continuation of the feed tube element 16, and contains a plurality of helically angled deflector blades 22, which form similarly angled passages 24 therebetween through which the blowing medium flows into the lance tube and by which a lateral component or angular velocity is imparted to the flowing medium. Such lateral deflection creates a desirable degree of turbulence and nonlaminar flow with a limited degree of back pressure. Such turbulizers constructed and installed in the manner shown in the drawings, have been used for many years, but with solid, imperforate feed tube elements and have been found to improve the heat transfer between the lance tube and the blowing medium throughout a distance of many feet forwardly from the turbulizer.

Where it is necessary to use high pressures and rates of blow in order to achieve proper cleaning, however, it has not been possible to use such a turbulizer heretofore, because of the aforementioned vibration and resultant damage to the lance tube. For example, with a 2⅜" feed tube, use of such a turbulizer has been limited to steam flow rates not exceeding 200 lb./min. and to air flow rates not exceeding 3500 SCFM. Unsuccessful attempts to solve this problem have been made in the past by forming radial holes in the outer wall of the turbulizer itself.

In the research and experimentation which resulted in the present invention, it was found that the pressure factors, including the pressure drop caused by the turbulizer and the effect of the gap 18, are such that if radial holes are formed through the wall of the feed tube itself in a higher pressure area upstream from the turbulizer, the vibration can be effectively damped to such extent that there is no undesirable vibratory contact between the feed tube and lance tube.

With a 2⅜" O.D. lance tube, four 7/16" diameter holes drilled through the lance tube 6" upstream from the turbulizer and equally peripherally spaced around the feed tube, as shown at 25, produce effective damping, in addition to which there is an actual increase in heat transfer and cooling effect for a distance forwardly from the turbulizer equivalent to approximately 140 times the internal diameter of the lance tube. Beyond such distance the heat transfer and cooling effect fall off to values less than occur where using a turbulizer without the vibration damping jet orifices 25, due to the greater heat transfer to the blowing medium closer to the turbulizer, but the invention may of course nevertheless remain advantageous, depending upon operating conditions.

Figure 6:
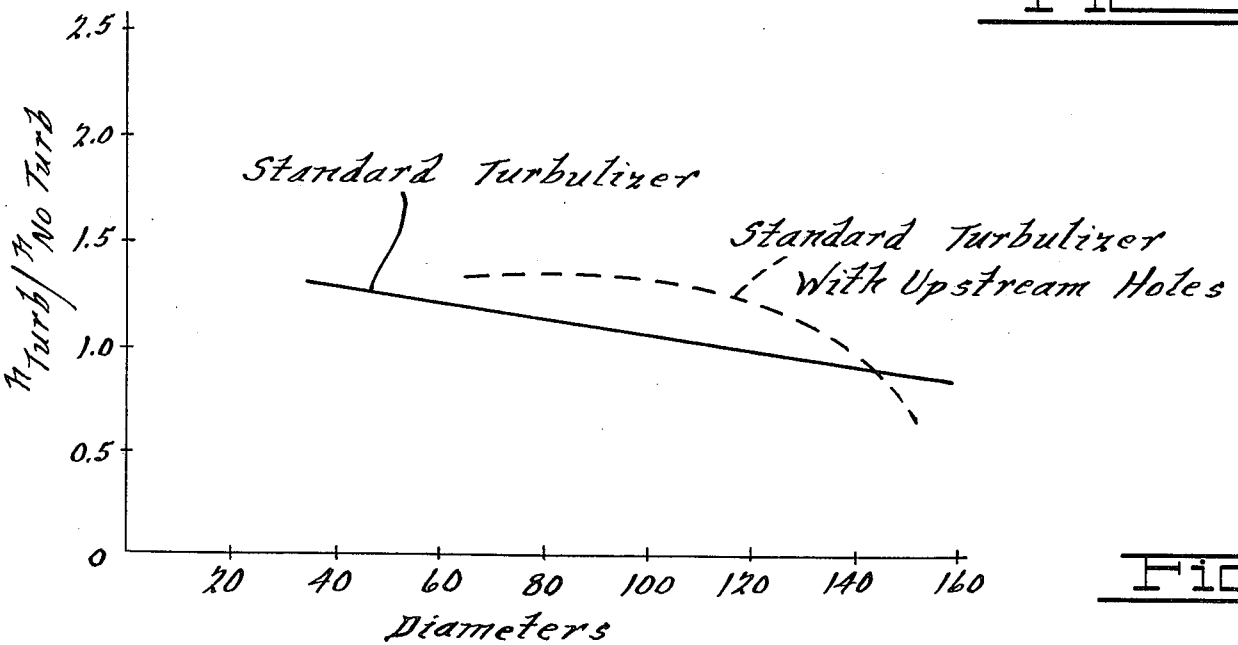
FIG. 6 is a graph showing relative performance of turbulizer-equipped sootblowers with and without the provision of the reaction jet orifices which are employed in practicing the present invention.

In FIG. 6 the vertical ordinate indicates heat transfer enhancement in terms of the ratio of the heat transfer coefficient with the turbulizer to the coefficient without one. The horizontal abscissa indicates length in the lance tube forwardly from the end of the feed tube and is graduated in multiples of lance tube I.D. The solid curve in FIG. 6, marked "Standard Turbulizer," shows graphically the heat transfer enhancement achieved under typical conditions in the operation of an IK-type long travel sootblower having a 2⅜" O.D. feed tube, a 4" lance tube, and having a turbulizer of the type shown, positioned as shown, but with no holes in the feed tube. The broken curve, marked "Standard Turbulizer with Upstream Holes," shows the heat transfer enhancement with the same apparatus and conditions but with incorporation of reaction jet or snubber holes as 25 in accordance with the embodiment above described. It will be seen that the addition of this feature actually increases cooling efficiency, out to approximately 140 diameters, in addition to overcoming the vibration and fatigue problem.

Figure 7:
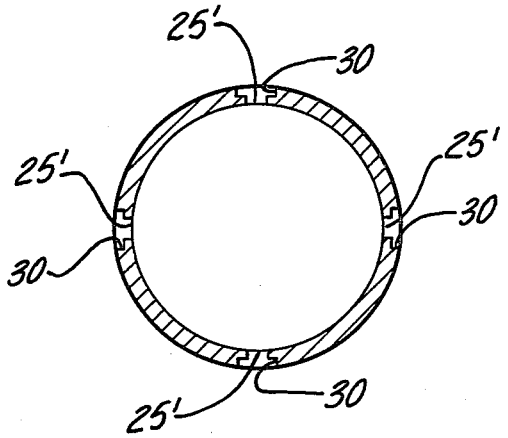
FIG. 7 is a cross-sectional view of a modified construction, taken transversely through the damping jet orifices.

In a further embodiment of the invention (FIG. 7), a groove or counterbore 30 may be provided in the feed tube, surrounding the orifices 25', thereby recessing the outer ends of the jet orifices somewhat below the surface of the feed tube. This is done for the purpose of increasing the ratio of reaction force to hole diameter and minimizing the bypass of blowing fluid.

Figure 8:
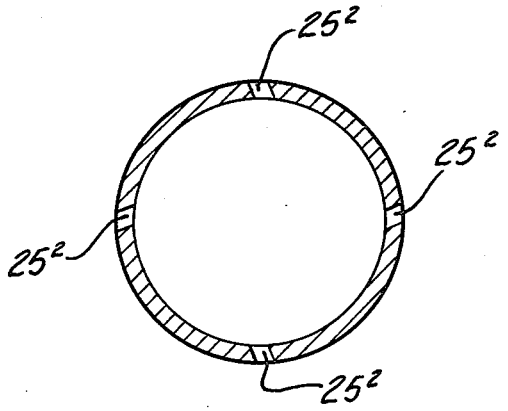
FIG. 8 is a view similar to FIG. 7 showing another modified construction.

In another modification (FIG. 8), the reaction jet orifices $25^2$ are drilled non-radially, in a similar angular direction to the inclination of the turbulizer vanes.

Neither of the two modifications last described have yet been tested. They are described herein in order to make a full disclosure of the different modes conceived by the inventor for carrying out the invention and which may be expected to still further improve its performance.

While preferred embodiments of the invention have been described herein, it will be appreciated that various modifications and changes may be made without departing from the spirit and scope of the appended claims.

What is claimed is:

1. In a retractable sootblower construction including a feed tube adapted to be connected to a source of blowing fluid under pressure, a lance tube having an inside diameter exceeding the outside diameter of and slidably overfitted on and adapted to be supplied with blowing fluid from the feed tube and having discharge nozzle means appurtenant to its outer end whereby said fluid may be projected from the lance tube against surfaces to be cleaned, and turbulizer means carried by an open end portion of the feed tube within the lance tube, the internal cross-sectional area of the turbulizer means being less than that of the feed tube, said turbulizer means causing a drop in pressure between the interior of the feed tube element and the lance tube during operation, the improvement which comprises a plurality of openings extending through the wall of the feed tube at radially spaced positions, said openings being spaced longitudinally from said turbulizer and from said open end portion of the feed tube.

2. A sootblower construction as defined in claim 1 wherein said orifices are uniformly peripherally spaced around the feed tube.

3. A sootblower construction as defined in claim 1 including recessed portions in the outer wall of said feed tube element and wherein said orifices are located in said recessed portions.

4. A sootblower construction as defined in claim 1 wherein said turbulizer means imparts a helical component to the blowing fluid and wherein the axes of said orifices are inclined in directions to discharge blowing fluid at non-radial angles which impart rotation to the blowing fluid in the same general angular direction as the turbulizer means.

* * * * *